United States Patent [19]

Gamblin

[11] Patent Number: 4,533,441

[45] Date of Patent: Aug. 6, 1985

[54] PRACTICAL AMORPHOUS IRON ELECTROFORM AND METHOD FOR ACHIEVING SAME

[75] Inventor: Rodger L. Gamblin, Dayton, Ohio

[73] Assignee: Burlington Industries, Inc., Greensboro, N.C.

[21] Appl. No.: 595,449

[22] Filed: Mar. 30, 1984

[51] Int. Cl.[3] ..... C25D 1/00; C25D 3/56

[52] U.S. Cl. ..... 204/3; 204/44.7

[58] Field of Search ..... 204/3, 4, 12, 44.7, 204/23, 25

[56] References Cited

U.S. PATENT DOCUMENTS

| | | | |
|---|---|---|---|
| 3,086,927 | 4/1963 | Chessin et al. | 204/43 |
| 3,354,059 | 11/1967 | Koretzky | 204/12 |
| 3,463,708 | 8/1969 | Grant | 204/43 |
| 3,518,170 | 6/1970 | Koretzky | 204/43 |
| 3,634,209 | 1/1972 | Wolf et al. | 204/40 |
| 3,986,867 | 10/1976 | Masumoto et al. | 75/126 A |
| 4,033,835 | 7/1977 | Lerner et al. | 204/43 S |
| 4,101,389 | 7/1978 | Uedaira | 204/44 |
| 4,108,739 | 8/1978 | Tadokoro et al. | 204/40 |
| 4,144,058 | 3/1979 | Chen et al. | 75/170 |
| 4,190,438 | 2/1980 | Aso et al. | 75/123 B |
| 4,400,208 | 8/1983 | Ackermann | 75/129 |

*Primary Examiner*—Thomas Tufariello

*Attorney, Agent, or Firm*—Cushman, Darby & Cushman

[57] ABSTRACT

Amorphous iron-phosphorus electroforms may be fabricated electrolytically from a plating bath which contains at least one compound from which iron can be electrolytically deposited, at least one compound which serves as a source of phosphorus such as hypophosphorous acid, and at least one compound selected from the group consisting of glycine, $\beta$-alanine, DL-alanine, and succinic acid. The electroforms can be fabricated over a very wide current density range. The stress in the plating can advantageously be further lowered by including in the bath at least one compound which serves as a source of sulfur, such as naphthalene trisulfonic acid or ferrous sulfate.

12 Claims, No Drawings

PRACTICAL AMORPHOUS IRON ELECTROFORM AND METHOD FOR ACHIEVING SAME

FIELD OF THE INVENTION

This invention relates to the field of electroplating, and in particular to a novel method of electroplating coatings and electroforms consisting essentially of iron and phosphorus having utility in making inductive devices such as amplifiers.

BACKGROUND

At present, silicon-iron is a standard for use in most induction devices since it combines a high saturation flux density with relatively high electrical resistivity, magnetic permeability and low hysteresis loss. Silicon-iron is also attractive because it is relatively inexpensive. To date, silicon-iron is the primary material in use in transformer core laminations in the primary power net in the United States.

Even though it does possess favorable characteristics, transformers in the primary power net in the United States which incorporate this material account for about a 3.1% loss of power transmitted, with approximately 1.5% lost in the core and 1.5% lost in the transformer winding (in transformer design, system loss is generally minimized if the design is arranged so that core and resistive losses are equal). The losses in the core have an economic value of nearly half a billion dollars annually.

There have been developed a number of glassy alloy materials which have unusual ferromagnetic properties. The materials are amorphous, i.e. they do not possess a crystal structure. The lack of crystalline structure in amorphous (glassy) metals is associated with a high degree of magnetic softness, a property which is desirable in any material intended to be used as an inductor. Glassy metals can generally be fabricated by rapidly quenching (also called splat cooling) an alloy which is usually about 20% of a metalloid such as carbon, silicon, phosphorus or boron and about 80% of a metal such as iron. The cooling rate is designed to be so rapid that a crystal structure does not have time to form.

In addition to rapid quenching, amorphous materials can also be realized by vacuum deposition, sputtering, plasma spraying, electrodeposition, and electroless deposition. Whatever the means of preparation, however, amorphous materials are generally realized by alloying the metal and metalloid in proportions such that a eutectic would be found in ordinary metallurgy.

The realization that certain glassy materials have soft magnetic properties suggested that they could offer a potentially large reduction in core losses in power distribution transformers with attendant savings of up to several hundred million dollars, as discussed above. The potential savings have led to interest in such systems and have led to considerable inquiry in both material and device fabrication.

The development of low stress amorphous metal electroforms having reasonable thicknesses along with low edge-to-edge and end-to-end thickness variation and minimal surface roughness would therefore be useful to the electrical industry. However, rapidly quenched materials are limited with regard to the thickness of material that can be realized. The inherent nature of rapid quenching involves heat transfer and, to date, with the exception of some rather cumbersome shock techniques, the cooling requirement restricts the maximum realizable thickness of quenched iron-phosphorus to approximately one-thousandth of an inch. Rapidly quenched materials also sometimes exhibit considerable edge-to-edge and end-to-end thickness variations along with surface roughness.

It is believed that thick iron-phosphorus electroforms would be particularly useful in fabricating, e.g. transformers using conventional laminating methodology used to make silicon-iron cores. Rapidly quenched iron-phosphorus is too thin to be laminated into a core material, and is instead formed by a fairly complicated process into a core torus through which metal conductors (e.g. copper) are wound by a process called re-entrant winding. Re-entrant winding is much more complicated and harder to implement than conventional core lamination processes. And, using the thin layers produced by rapid quenching, a great number of thin, rapidly quenched layers would be required to obtain a core of normal size. Thus, because rapid quenching cannot achieve thick layers of iron-phosphorus (i.e. iron-phosphorus electroforms), conventional core fabricating methodology is not used with rapidly quenched materials.

To date, the art has not developed, to the inventor's knowledge, a practical electrochemical method which allows plating iron-phosphorus layers. In particular, electroforming would seem to be a desirable means of fabricating iron-phosphorus layers or laminations inasmuch as, by controlling electrodeposition parameters (such as current density), bath conditions (such as temperature, pH etc.) and material balance, careful control of plating and electroforming operations can be maintained. However, very few researchers have developed any method at all for plating amorphous iron-phosphorus, let alone a practical method which allows plating low stress iron-phosphorus having good (i.e. low) thickness variations and little if any surface roughness.

For example U.S. Pat. No. 4,101,389 to Uedaira discloses the production of amorphous iron-phosphorus from an iron (0.3 to 1.7 molar divalent iron) and hypophosphite (0.07–0.42 molar hypophosphite) bath using current densities between 3 and 20 amps/square decimeter (between 30 and 200 milliamps/cm$^2$) a pH range of 1.0–2.2, and a temperature range of 30° C. At the low pH values generally disclosed therein, however, a disadvantage is that redissolution of the iron occurs. Further, within the temperature range cited it is difficult to obtain deposits free of oxide inclusions. Such inclusions cause the plating to crumble readily and thereby render it unsuitable for use.

U.S. Pat. No. 3,086,927 to Chessin et al discloses the addition of minor amounts of hypophosphite to an iron plating bath to harden the iron. This patent cites using between 0.06 and 6 grams/liter of hypophosphite at a temperature between 100°–170° F. over a current density range of 20 to 100 amps/ft$^2$. The disadvantage with this method is that the hydrogen overvoltage for iron declines sharply as hypophosphite is added to the bath. Both plating efficiency and throw suffer and the quality of the plating declines markedly as hypophosphite is increased in the bath.

A bath which could be used to achieve amorphous iron-phosphorus electroplating practically, i.e. with low stress and over a wide range of current density, would thus provide a means for achieving useful amorphous iron-phosphorus platings and electroforms which, due to the fact that they were low stress, could be plated more thickly than permitted by the rapid quenching prior art. Such a bath would also permit fabricating useful inductive devices by presently employed methods. The present invention provides a method which, it is believed, allows achieving low stress amorphous iron-phosphorus electroplatings and electroforms over a wide range of current density values.

SUMMARY OF THE INVENTION

The present invention provides amorphous and low stress iron-phosphorus electroplatings and electroforms by adding, to a bath containing at least one compound from which iron can be electrolytically deposited and hypophosphorous acid and/or an alkali metal hypophosphite salt as the source of phosphorus, a compound which acts as a complexing agent selected from the group consisting of glycine, β-alanine ($NHCH_2CH_2COOH$), DL-alanine ($CH_3CH(NH)COOH$) and succinic acid ($HOOCCH_2CHCOOH$).

Generally the ability of bath additives to improve the brightness and throw (i.e. that property of a bath which allows a plating to deposit even at low current densities) of plating is recognized as being a function of the ability of a particular bath additive to form a complex with iron ions. The improvement in plating is generally thought to be connected with displacing the normal cage of water molecules which surrounds iron in the bath and, therefore, with changing the characteristics of the iron atom during plating. Beyond this, however, the details of how these bath additives alter the nature of the plating process are not well understood.

The fact of complexation alone, however, is not a sufficient criterion by which to judge plating quality. There exist quite a large number of compounds which are known to complex iron. But, the majority of complexing agents do not result in any significant benefit being imparted to the plating bath. Thus, it is surprising that the individual complexing agents mentioned above enable bright plating with good throw to be achieved over a much wider current density range than heretofore disclosed by the prior art.

It is an object of this invention to provide a plating bath for amorphous iron-phosphorus which yields platings and electroforms having low stress and good throw and which may be used to plate over a wide range of current densities.

These and other objects and advantages of the invention will become more apparent and more readily appreciated from the following detailed description.

DETAILED DISCUSSION

Iron-phosphorus alloys can be electrolytically deposited from aqueous solutions of ferrous salts and hypophosphorous acid according to these equations:

$$Fe^{+2} + 2e^- \rightarrow Fe \qquad E_o = -.44\ V \qquad (1)$$

$$HPH_2O_2 + H^+ + e^- \rightarrow P + 2H_2O\ E_o = -.51\ V \qquad (2)$$

An amount of phosphorus of at least 5 atomic percent should be codeposited with the iron in order to ensure that the plating is amorphous. As a practical matter, the highest amount of phosphorus which can be incorporated into the plating is relatively insensitive to the amount of phosphorus donor compound employed. The pH of the bath during plating should be between about 2.5 and about 3.5.

The iron source compound can be any of those known to the art such as ferrous sulfate or ferrous chloride. Iron (ferrous) sulfate can be added to the bath at a level of about 0.8–1.0 molar. At this level of sulfate, ferrous chloride can advantageously also be added at a level of about 0.2–0.5 molar.

The phosphorus source compounds may be selected from the group consisting of hypophosphorous acid and alkali metal hypophosphites. A proper ratio between hypophosphorous acid and alkali metal hypophosphite helps buffer the bath to an appropriate level of pH. This means of buffering is well known to those versed in the art. The total of hypophosphite ion and hypophosphorous acid in the bath should be between about 0.1 to about 0.5 molar.

The temperature of the bath should be between about 70° and about 95° C., with about 80° C. being optimum.

Using the above conditions, cathode efficiency usually ranges between about 45 and about 65%.

Current densities between about 2 and about 400 $mA/cm^2$ result in satisfactory platings having thicknesses up to about 15 thousandths of an inch. It is believed that greater thicknesses can also be achieved. Current densities between 70 to 120 $mA/cm^2$ are preferred.

At least one bath additive selected from the group consisting of glycine, β-alanine, DL-alanine and succinic acid is added to the bath at a level generally between about 0.05 and 0.75 molar.

It has been discovered that bath cleanliness is an important consideration in achieving thick platings and in eliminating pitting. Agitating the bath also contributes to thick, pit-free platings. To achieve agitation one may employ conventional means such as a magnetic stirring bar. Advantageously, plating can be conducted using a bath tank equipped with a circulation and filtering system as known to the art which provides agitation and at the same time provides for a clean bath. It is noted that the larger the bath volume, the greater the resistance to change in pH and concentration of various ingredients, and the greater is the reduction in pitting associated with the diminished concentration of particulate matter in the bath.

The formation of ferric ions by the oxidation of ferrous ions in the bath has been determined to contribute to the production of brittle deposits. Ferric ion may be avoided by conventional means such as the addition of small quantities of iron shavings or filings, and these serve effectively to reduce any ferric ion which occurs during the electroplating process to ferrous ion.

It has also been discovered that the addition of a source of sulfur to the bath aids in further reducing plating stress and yielding cohesive, ductile, free standing deposits (i.e. electroforms). Compounds which can serve as a source of sulphur include those selected from the group consisting of naphthalene trisulfonic acid, sulfamic acid, and saccharin, with naphthalene trisulfonic acid being preferred. These compounds should be added to the bath in an amount sufficient to make the bath concentration between about 0.03 and about 0.2 molar in sulfur.

The anode efficiency of the bath is near 100%. It is important to use iron or carbon steel anodes in the bath inasmuch as hard anodes (e.g. carbon or platinized titanium) destroy the bath very rapidly, i.e. such that it no longer gives rise to low-stress plating. Anode materials such as 1010 and 1020 carbon steel are useful. However, these anodes also contain carbon and carbon particles can form and dislodge from the anode and be disseminated through the bath. To prevent carbon particles contributing to pitting, the anode can be isolated as known in the art by surrounding it with a porous fabric bag or a ceramic battery jar. Isolating the anode also improves the bath stability by decreasing the rate of increase of ferrous ions in the bath at the cathode.

The invention will be further explained and illustrated by means of the following examples.

EXAMPLE 1

The following bath illustrates the inclusion of both $FeSO_4$ and $FeCl_2$ in a bath which provides iron-phosphorus electroforms.

| | |
|---|---|
| 134 ml/l $FeCl_2$ 30% solution | 80° C. |
| 133 g/l $FeSO_4.4H_2O$ | 0.075 A/cm$^2$ |
| 40 ml/l $H_3PO_2$ | 2.6 pH |
| 17 g/l $NaH_2PO_2$ | |
| 67 g/l β-alanine | |
| 13 ml/l $NH_4OH$ | |
| .17 g/l $SnCl_2$ | |

The above bath enables the production of low-stress platings and electroforms having a thickness up to about 15 thousandths of an inch.

EXAMPLE 2

The following bath enables the production of low-stress, smooth plating.

180 grams ferrous chloride
80 grams sodium hypophosphite
90 grams β-alanine
pH adjustment to 3.5 with HCl
90° C., 100–250 ma/cm$^2$.

EXAMPLE 3

The following bath gives bright plating. The plating is unacceptable, however, inasmuch as the plating is very brittle and stressed. This example, taken in conjunction with Example 4, illustrates that inclusion of a source of sulfur can be desirable to lower plating stress.

| | |
|---|---|
| 617 ml/l $FeCl_2$ 30% solution | 90° C. |
| 40 ml/l $H_3PO_2$ 50% solution | 0.1 A/cm$^2$ |
| 37 g/l $NaH_2PO_2$ | 1.8 pH |
| 7 g/l glycine | steel anode |
| 7 g/l β-alanine | .0111 g/amp-min cathode efficiency |
| 13 ml/l $NH_4OH$ | |

EXAMPLE 4

The following bath illustrates the inclusion of a sulfur source compound to lower stress,

| | |
|---|---|
| 296 ml/l $FeCl_2$ 30% solution | 75° C. |
| 30 g/l naththalene trisulfonic acid | 0.07 A/cm$^2$ |
| 40 ml/l $H_3PO_2$ 50% solution | 2.0 pH |
| 36.7 g/l $NaH_2PO_2$ | steel anode |
| 6.7 g/l glycine | |
| 33 g/l β-alanine | |
| 13 ml/l $NH_4OH$ | |

EXAMPLE 5

The following bath provides iron-phosphorus electroforms at good plating rates and with good bath stability.

| | |
|---|---|
| 33 ml/liter 50% $H_3PO_2$ | pH 3 |
| 27 gm/liter β-alanine | temp. 80° C. |
| 27 gm/liter glycine | current density 5–100 A/ft$^2$ |
| 13 gm/liter $NaHPO_2$ | |
| 167 gm/liter $FeSO_4$ | |
| 83 ml/liter 30% $FeCl_2$ solution | |
| 10 ml surfynol (trademark of Air Products and Chemicals, Allentown, Pa.) surfactant | |

Methods of electroforming as known and commonly used in the art may be employed in this invention. In particular, amorphous iron-phosphorus can be electroformed onto the surface of a flat piece of stainless steel which has optionally been oxidized, e.g. with chromic acid, to promote poor adhesion of the electroform. Following electroforming, iron-phosphorus sheet can be removed by simply flexing the stainless. Other conductive substrates can also be used as known to the art.

Although only a few exemplary embodiments of this invention have been described in detail above, those skilled in the art will readily appreciate that many modifications are possible in the exemplary embodiments without materially departing from the novel teachings and advantages of this invention. Accordingly all modifications are intended to be included within the scope of this invention as defined in the following claims.

What is claimed is:

1. A method of fabricating amorphous iron-phosphorus electroforms, comprising electroforming on a conductive substrate in a bath containing:

at least one compound from which iron can be electrolytically deposited, at least one compound from which phosphorus can be electrolytically deposited, selected from the group consisting of hypophosphorous acid and alkali metal hypophosphite salts in an amount sufficient to render said iron amorphous, and at least one complexing agent selected from the group consisting of glycine, β-alanine, DL-alanine and succinic acid.

2. The method of claim 1 wherein said electroform is plated at a current density between about 2 and about 400 mA/cm$^2$.

3. The method of claim 1 wherein said electroform is plated at a pH between about 2.5 and about 3.5.

4. The method of claim 1 wherein said complexing agent is present in said bath at a level between about 0.05 and about 0.75 molar.

5. The method of claim 1, wherein said bath further includes a source of sulfur in the form of at least one compound selected from the group consisting of naphthalene trisulfonic acid, ferrous sulfate, sulfamic acid, and saccharin.

6. The method of claim 1, wherein said iron compound is selected from the group consisting of ferrous sulfate and ferrous chloride.

7. An amorphous iron-phosphorus electroform produced by electroforming iron-phosphorus on a conductive substrate using a bath containing:

at least one compound from which iron can be electrolytically deposited, at least one source of phosphorus selected from the group consisting of hypophosphorous acid and alkali metal hypophosphite salts in an amount sufficient to render said iron amorphous, and at least one complexing agent selected from the group consisting of glycine, $\beta$-alanine, DL-alanine and succinic acid.

8. The electroform of claim 7 wherein said electroform is plated at a current density between about 2 and about 400 mA/cm$^2$.

9. The electroform of claim 7 wherein said electroform is plated at a pH between about 2.5 and about 3.5.

10. The electroform of claim 7 wherein said complexing agent is present in said bath at a level between about 0.05 and about 0.75 molar.

11. The electroform of claim 7, wherein said bath further includes a source of sulfur in the form of at least one compound selected from the group consisting of naphthalene trisulfonic acid, ferrous sulfate, sulfamic acid, and saccharin.

12. The electroform of claim 7, wherein said iron compound is selected from the group consisting of ferrous sulfate and ferrous chloride.

* * * * *